US009702256B2

(12) United States Patent
Szijarto et al.

(10) Patent No.: US 9,702,256 B2
(45) Date of Patent: Jul. 11, 2017

(54) TURBINE BLADE WITH COOLING ARRANGEMENT

(71) Applicant: Siemens Aktiengesellschaft, Munich (DE)

(72) Inventors: Janos Szijarto, Finspong (SE); Esa Utriainen, Finspong (SE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 232 days.

(21) Appl. No.: 14/442,196

(22) PCT Filed: Oct. 25, 2013

(86) PCT No.: PCT/EP2013/072377
§ 371 (c)(1),
(2) Date: May 12, 2015

(87) PCT Pub. No.: WO2014/075895
PCT Pub. Date: May 22, 2014

(65) Prior Publication Data

US 2016/0305253 A1 Oct. 20, 2016

(30) Foreign Application Priority Data

Nov. 16, 2012 (EP) ..... 12192893

(51) Int. Cl.
*F01D 5/18* (2006.01)

(52) U.S. Cl.
CPC ..... *F01D 5/187* (2013.01); *F01D 5/186* (2013.01); *F05D 2220/32* (2013.01); *F05D 2260/201* (2013.01)

(58) Field of Classification Search
CPC ..... F01D 5/186; F01D 5/187; F05D 2220/32; F05D 2260/201
See application file for complete search history.

(56) References Cited

U.S. PATENT DOCUMENTS

| | | | |
|---|---|---|---|
| 5,702,232 | A | 12/1997 | Moore |
| 7,527,474 | B1 | 5/2009 | Liang |
| 7,527,475 | B1 | 5/2009 | Liang |
| 7,625,180 | B1 | 12/2009 | Liang |
| 7,857,589 | B1 | 12/2010 | Liang |
| 7,862,299 | B1 | 1/2011 | Liang |
| 7,985,050 | B1 | 7/2011 | Liang |
| 8,011,888 | B1 | 9/2011 | Liang |
| 8,061,990 | B1 | 11/2011 | Ryznic |

(Continued)

FOREIGN PATENT DOCUMENTS

| | | |
|---|---|---|
| EP | 1209323 A2 | 5/2002 |
| EP | 1953343 A2 | 8/2008 |

*Primary Examiner* — Igor Kershteyn
(74) *Attorney, Agent, or Firm* — Beusse Wolter Sanks & Maire

(57) ABSTRACT

A turbine blade with a cooling arrangement is provided. The turbine blade includes at least one supply chamber and at least one impingement cavity. The supply chamber includes multiple impingement channels configured to direct a cooling fluid from within the supply chamber to the impingement cavity. The supply chamber also includes one or more collector channels such that the cooling fluid from the impingement cavity is directed to a collector cavity within the turbine blade.

13 Claims, 3 Drawing Sheets

(56) References Cited

U.S. PATENT DOCUMENTS

| | | | | |
|---|---|---|---|---|
| 8,328,518 | B2 * | 12/2012 | Liang | F01D 5/187 415/115 |
| 8,511,968 | B2 * | 8/2013 | Liang | F01D 5/187 415/115 |
| 8,535,004 | B2 * | 9/2013 | Campbell | F01D 5/148 415/115 |

* cited by examiner

TURBINE BLADE WITH COOLING ARRANGEMENT

CROSS REFERENCE TO RELATED APPLICATIONS

This application is the U.S. National Stage of International Application No. PCT/EP2013/072377 filed Oct. 25, 2013, and claims the benefit thereof. The International Application claims the benefit of European Application No. EP12192893 filed Nov. 16, 2012. All of the applications are incorporated by reference herein in their entirety.

FIELD OF INVENTION

The present invention generally relates to turbine blades. More specifically, the present invention relates to a hollow turbine blade provided with a cooling arrangement.

BACKGROUND OF INVENTION

In a typical turbine engine, also known as a gas turbine or a combustion turbine, an upstream compressor is coupled to a downstream turbine, and a combustion chamber is located in-between. A gas stream enters the turbine engine from the compressor end, and is highly pressurized in the upstream compressor; the compressed gas stream subsequently enters the combustion chamber at a high velocity, fuel is added thereto and ignited to impart additional energy to the gas stream; the energized gas stream subsequently drives the downstream turbine.

In principle, efficiency of a turbine engine varies in direct relation to operating temperature in the combustion chamber. Thus, in order to achieve high efficiency, it is desirable to operate the combustion chamber at a high temperature. Accordingly, the combustion chamber is operated at high temperatures often exceeding 1,200 degrees Centigrade. However, the maximum operating temperature is limited by the thermal strength of various internal components, and in particular, turbine blades located in the downstream turbine. In order to increase the thermal strength thereof, the turbine blades must be made of materials capable of withstanding such high temperatures. In addition, the turbine blades are provided with various cooling arrangements for increasing tolerance towards excessive temperatures, and thereby, prolonging the life of the blades.

Typically, turbine blades include a root portion and a platform at one end and an elongated portion forming a blade that extends outwardly from the platform. The blade is ordinarily composed of a tip opposite the root section, a leading edge, and a trailing edge extending from the platform adjacent to the root section to the tip of the turbine blade. Such turbine blades have a hollow construction and contain an intricate maze of cooling channels forming a cooling arrangement. In a typical turbine blade cooling arrangement, cooling fluid is tapped from the compressor and provided to the cooling channels in the turbine blades. The cooling channels often include multiple flow paths that are designed to maintain all aspects of the turbine blade at a relatively uniform temperature.

Several different cooling arrangements based on a combination of convective, impingement, and external film-based cooling have been proposed in the state of the art. In a typical cooling arrangement for a turbine blade, longitudinal partitions are formed inside a turbine blade, which, together with side walls of the turbine blade, form a supply chamber and, adjacent to the supply chamber, one or more impingement cooling chambers. The cooling fluid flows from the supply chambers into the adjacent impingement cooling chambers, thereby intensely cooling the turbine blade from the inside and enabling the turbine engine to be operated with high efficiency at high combustion temperatures. The cooling fluid exits from the impingement cooling chambers through film-cooling holes in the sidewalls of the turbine blade creating a barrier layer between the outer surface of the turbine blade and the hot gas, which further reduces the thermal load on the turbine blade.

As mentioned earlier, the cooling fluid supplied to the cooling arrangement in a turbine blade is bled from the upstream compressor, and thus, represents additional energy consumption in the turbine engine. Hence, the efficiency of the cooling arrangement is an important consideration in design of turbine engine since the efficiency of the cooling arrangement impacts not only overall operational life of the turbine engine components but also overall efficiency of the turbine engine itself.

The documents U.S. Pat. No. 8,011,888 B1, U.S. Pat. No. 8,061,990 B1, U.S. Pat. No. 7,625,180 B1, U.S. Pat. No. 7,527,475 B1, U.S. Pat. No. 7,985,050 B1, EP 1 953343 A2 disclose a turbine blade according to the preamble of the independent claim.

It is therefore desirable to provide an improved cooling arrangement such that increased cooling efficiency is achieved, that is, an amount of cooling fluid required for desired heat removal is reduced.

SUMMARY OF INVENTION

Accordingly, an object of the present invention is to provide a turbine blade with an improved cooling arrangement such that cooling efficiency is increased, and thereby, an amount of cooling fluid required for desired heat removal is reduced.

This object of the present invention is achieved by a turbine blade according to the independent claim. Further embodiments of the present invention are addressed in the dependent claims.

An underlying idea of the present invention is to provide a turbine blade with a cooling arrangement such that cooling fluid supplied to the turbine blade is initially used for impingement cooling of airfoil walls in a mid-chord section thereof and subsequently, is directed back towards an interior region of the turbine blade through an intermeshing arrangement of fluid channels. In the interior region, the cooling fluid is used for convective cooling, and finally, is discharged therefrom through multiple film-cooling holes. Therefore, the cooling arrangement of the present invention is configured for efficiently exploiting cooling (or heat absorbing) capacity of the cooling fluid.

In accordance with techniques of the present invention, turbine blade is provided. The turbine blade comprises an airfoil section, which comprises a leading edge and a trailing edge. The edges are spaced apart in a chord-wise direction and each of the edges extends in a span-wise direction from a root end to a tip end of the airfoil. The edges are interconnected through a suction-side wall and a pressure-side wall. The airfoil, between the suction-side and the pressure-side walls thereof, includes at least one supply chamber, at least one impingement cavity, and a collector cavity. The supply chamber is configured for receiving a cooling fluid from a cooling fluid source external to the turbine blade and supplying the cooling fluid to one or more cavities within the airfoil. The impingement cavity is connected to the supply chamber through a plurality of impingement channels. The impingement channels direct the cooling fluid from the supply chamber to the impingement cavity. The collector cavity is connected to the impingement cavity through one or more collector channels, wherein the collector channels direct the cooling fluid from the impingement cavity to the collector cavity.

Accordingly, the turbine blade of the present invention is provided with an improved cooling arrangement such that cooling efficiency is increased. Thus, an amount of cooling fluid required for desired heat removal is advantageously reduced.

BRIEF DESCRIPTION OF THE DRAWINGS

The present invention is further described hereinafter with reference to illustrated embodiments shown in the accompanying drawings, in which.

DETAILED DESCRIPTION OF INVENTION

Figure 1:
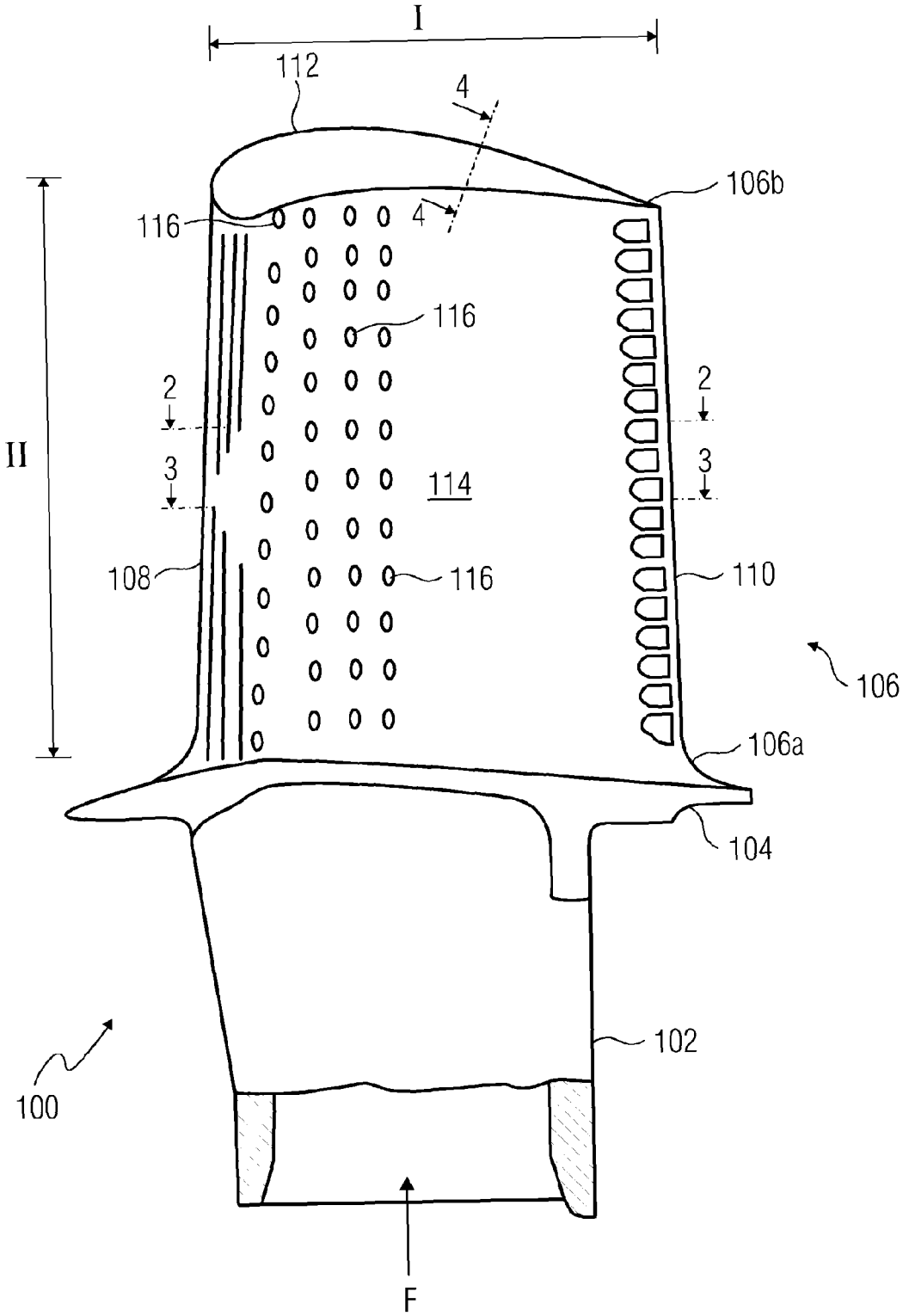
FIG. 1 illustrates a side view of a turbine blade in accordance with an embodiment of the present invention.

Various embodiments are described with reference to the drawings, wherein like reference numerals are used to refer to like elements throughout. In the following description, for purpose of explanation, numerous specific details are set forth in order to provide a thorough understanding of one or more embodiments. It may be evident that such embodiments may be practiced without these specific details.

Referring to FIG. 1, a side view of a turbine blade 100 is depicted in accordance with an embodiment of the present invention.

The turbine blade 100 typically includes three sections, namely a blade root 102, a blade platform 104, and an airfoil 106. The turbine blade 100, as used to herein, refers to rotor blades as well as stator blades (also referred to as stator vanes). The turbine blade 100 is mounted on a rotor or a stator with the help of the blade root 102 and the platform 104 in a well-known manner.

The airfoil 106 includes a leading edge 108 and a trailing edge 110. The edges 108, 110 are spaced apart in a chord-wise direction (I) and each of the edges 108, 110 extends in a span-wise direction (II) from a root end 106*a* of the airfoil 106 to a tip end 106*b* of the airfoil 106. The edges 108, 110 are interconnected through a suction-side wall 112 and a pressure-side wall 114 as generally well understood in the art. The suction-side and the pressure-side walls 112, 114 collectively delimit an internal region of the airfoil 106, which is thus, demarcated from an external region located outside the airfoil 106. The respective surfaces of the walls 112, 114 facing the internal region are referred to as inner surfaces thereof. Similarly, the respective surfaces of the walls 112, 114 facing the external region are referred to as outer surfaces thereof.

As shown in the adjoining figure, multiple film-cooling holes 116 are provided in the region adjacent to the leading edge 108. Similarly, multiple discharge channels 118 are provided towards the trailing edge 110. These features will be explained in more detail in conjunction with the following figures.

As generally known in the art, the rotor and/or stator on which turbine blade 100 is mounted, is adapted such that a cooling fluid (e.g. cooling gas) from a cooling fluid source located external to the turbine blade 100 is supplied to the turbine blade 100.

Figure 2:
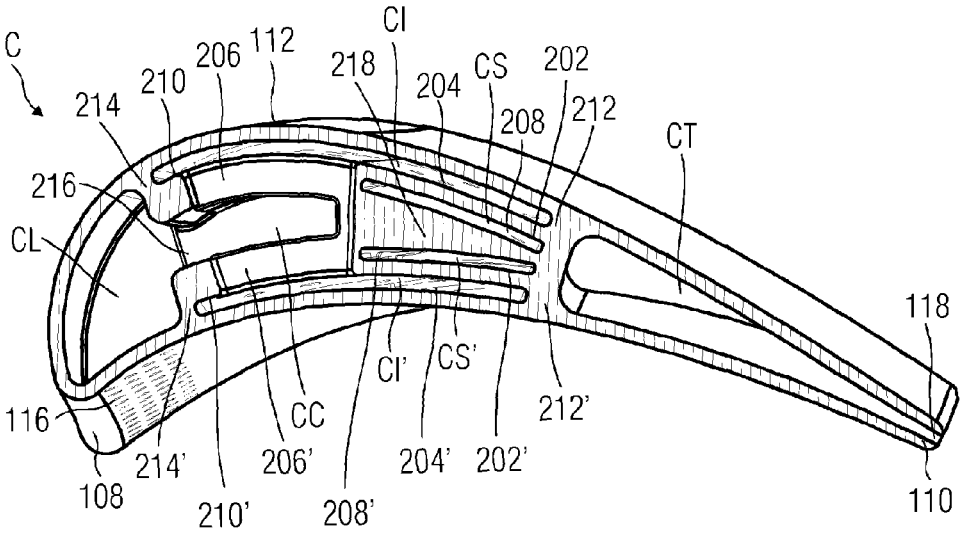
FIG. 2 illustrates a first cross-sectional view of the turbine blade in accordance with an embodiment of the present invention.
Figure 3:
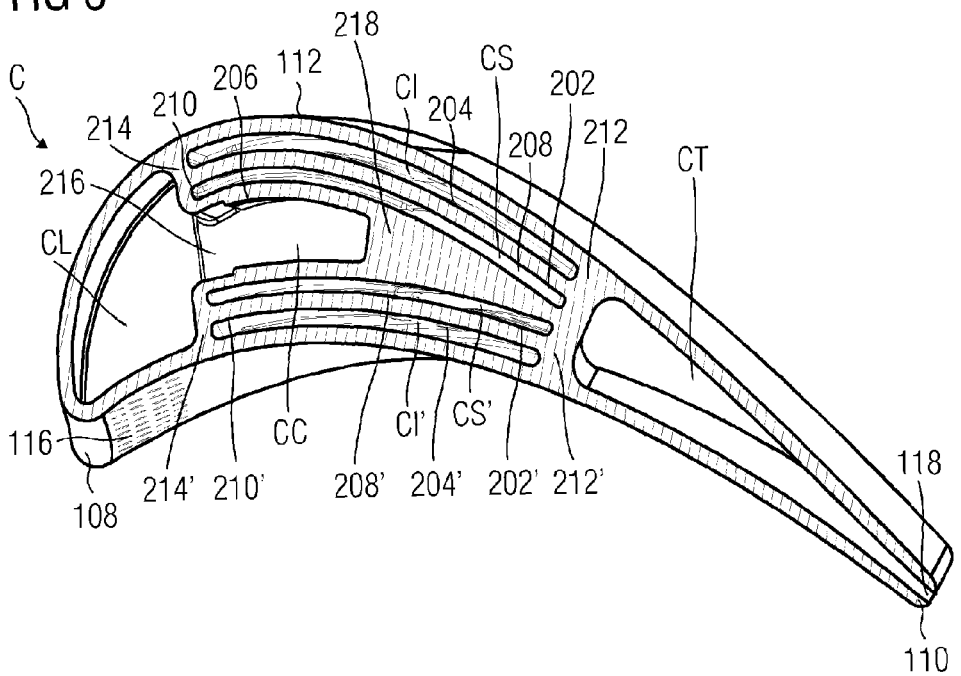
FIG. 3 illustrates a second cross-sectional view of the turbine blade in accordance with an embodiment of the present invention.
Figure 4:
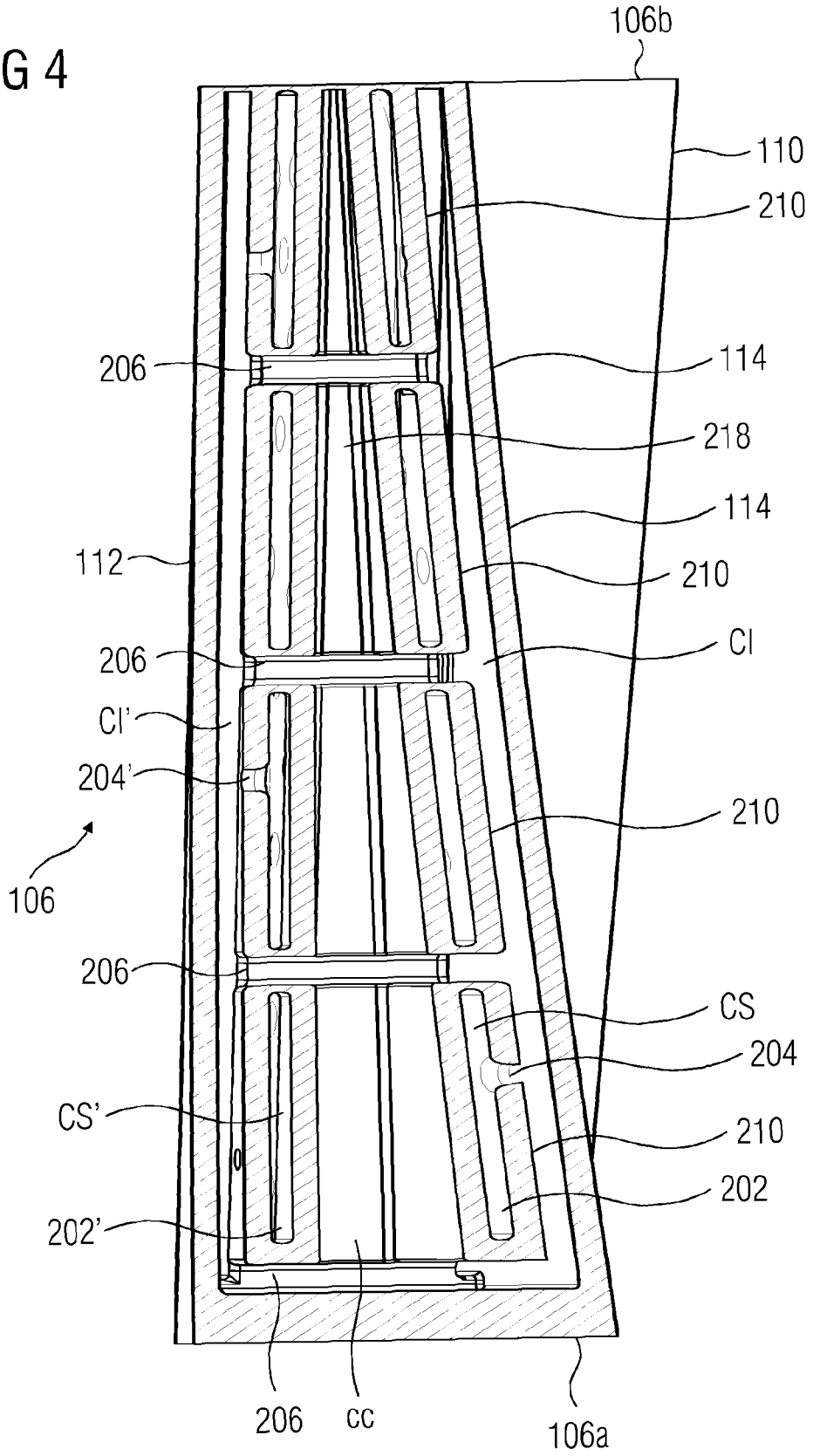
FIG. 4 illustrates a third cross-sectional view of the turbine blade in accordance with an embodiment of the present invention.

Referring now to FIGS. 2 through 4, a first, a second and a third cross-sectional view of the turbine blade are depicted in accordance with an embodiment of the present invention. The three cross-sectional views respectively correspond to cross-sectional planes 2-2, 3-3, and 4-4 indicated in FIG. 1.

In accordance with various techniques of the present invention, the airfoil 106 includes at least one supply chamber 202, 202', at least one impingement cavity (CI, CI'), and a collector cavity (CC).

Each supply chamber 202, 202' defines a supply cavity (CS). As explained in conjunction with FIG. 1, the turbine blade 100 receives the cooling fluid from a cooling fluid source. The turbine blade 100 is further configured such that the cooling fluid, thus received, is channelized through the blade root 102, and the platform 104 and provided to the supply cavity (CS) inside the supply chamber 202, 202'. Thus, the supply chamber 202, 202' is configured for receiving a cooling fluid from a cooling-fluid source external to the turbine blade 100. Further, the supply chamber 202, 202' is configured for supplying the cooling fluid to one or more cavities within the airfoil 106, as will be understood from the following description.

In the exemplary embodiment depicted in the adjoining figures, the airfoil 106 includes two supply chambers—a suction-side supply chamber 202 and a pressure-side supply chamber 202'.

The present invention will hereinafter be explained with reference to the two supply chambers 202, 202'. However, it should be noted that various techniques of the present invention may be implemented using any desired number of supply chambers. In one example, only one supply chamber may be used. In other examples, multiple supply chambers may be arranged on the suction-side wall and/or the pressure-side wall spaced along the chord-wise direction. All such embodiments are intended to be covered under the scope of the present invention.

As best depicted in FIGS. 2 and 3, the airfoil 106 also includes the impingement cavity (CI, CI'). The impingement cavity (CI, CI') may be formed in a suitable manner such that each impingement cavity (CI, CI') extends substantially parallel to the wall 112, 114.

In one exemplary embodiment of the present invention, at least a portion of each supply chamber 202, 202' extends substantially parallel to one of the walls 112, 114 and is coupled to the wall 112, 114 in a spaced apart relationship for defining an impingement cavity (CI, CI') there between. As will be readily apparent, owing to the aforementioned arrangement of the supply chambers 202, 202', each impingement cavity (CI, CI') extends substantially parallel to the wall 112, 114.

In particular, the suction-side supply chamber 202 extends substantially parallel to the suction-side wall 112, and is coupled thereto in a spaced apart relationship for forming a suction-side impingement cavity CI. Similarly, the pressure-side supply chamber 202' extends substantially parallel to the pressure-side wall 114, and is coupled thereto in a spaced apart relationship for forming a suction-side impingement cavity CI'.

Each supply chamber 202, 202' is connected to the impingement cavity (CI, CI') through multiple impingement channels 204. The impingement channels 204 direct the cooling fluid from the supply chamber 202, 202' to the impingement cavity (CI, CI') such that jets of cooling fluid impinge upon the inner surface of the wall 112, 114 for effecting impingement cooling thereof.

As generally well understood in the art, the suction-side wall 112 generally experiences greater thermal load relative to the pressure-side wall 114. Accordingly, in various advantageous embodiments of the present invention, the number of impingement channels 204 connecting the suction-side supply chamber 202 to the suction-side impingement cavity (IC) exceeds the number of impingement channels 204 connecting the pressure-side supply chamber 202' to the pressure-side impingement cavity (IC').

As particularly depicted in FIGS. 2 and 3, the airfoil 106 includes the collector cavity (CC). Each impingement cavity (CI, CI') is connected to the collector cavity (CC) through one or more collector channels 206. The collector channels 206 direct the cooling fluid from the impingement cavity (CI, CI') to the collector cavity (CC). Thus, the cooling fluid is directed back towards a central portion of the internal region within the airfoil 106.

In accordance with the techniques of the present invention, the collector channels 206 extend through the supply chamber 202, 202' before joining into the collector cavity (CC). The arrangement of collector channels 206 and the supply chamber 202, 202' is such that an intermeshed arrangement of fluid pathway is created.

In the exemplary embodiment of the present invention depicted in the adjoining figures, the collector cavity (CC) is formed between the suction-side supply chamber 202 and the pressure-side supply chamber 202'. In other words, the suction-side supply chamber 202 and the pressure-side supply chamber 202' are disposed within the airfoil 106 such as to form the collector cavity (CC) there between.

In various embodiments of the present invention, the number of impingement channels 204 is greater than the number of collector channels 206. In order to ensure desired flow continuity of the cooling fluid, a cross-sectional area of each collector channel 206 exceeds a cross-sectional of each impingement channel 204.

In an exemplary embodiment of the present invention, the number of the impingement channels 204 exceeds number of the collector channels 206 by a factor ranging from about 2 to about 25, and more advantageously, ranging from about 5 to about 15. Thus, for example, if four collector channels 206 are provided through each supply chamber 202, 202', the number of impingement channels 204 connecting each supply chamber 202, 202' to respective impingement cavities (CI, CI') ranges from at least about 8 to about 100. More advantageously, in this example, the number of impingement channels 204 ranges from about 20 to about 60.

The collector cavity (CC) is bounded by a leading-edge cavity (CL) towards the leading edge 108 and a trailing-edge cavity (CT) towards the trailing edge 110.

The collector cavity (CC) is connected to the leading-edge cavity (CL) through one or more coupling slots 216. In one exemplary embodiment of the present invention, respective ends of the supply chamber 202 and 202' develop towards the leading edge such that to delimit a fluid pathway extending in the span-wise direction (II) which function as the coupling slot 216. In various alternative embodiments of the present invention, the fluid pathway may be segmented along the span-wise direction (II) to form multiple coupling slots 206. The coupling slots 216 direct the cooling fluid from the collector cavity (CC) to the leading-edge cavity (CL).

As will be readily evident, a cross-sectional area of the coupling slots 206 is easily configurable during manufacturing to facilitate regulation of various flow-related parameters such as pressure drop, flow orientations, and so on for regulating the flow of cooling fluid from the collector cavity (CC) to the leading-edge cavity (CL).

The suction-side and pressure-side supply chambers 202, 202' are mutually coupled substantially along ends thereof towards the trailing edge 110. As shown in the adjoining figures, a partitioning wall 218 is used to achieve the coupling between the suction-side and pressure-side supply chambers 202, 202'. The partitioning wall 218 isolates the collector cavity (CC) from the trailing-edge cavity (CT). The partitioning wall 218 may have any suitable construction so long as the desired isolation between the collector cavity (CC) and the trailing-edge cavity (CT) is achieved. In the exemplary embodiment depicted in the adjoining figures, the partitioning wall 218 has a wedge-shaped construction.

As mentioned earlier in conjunction with FIG. 1, multiple film-cooling holes 116 are provided in the region adjacent to the leading edge 108. The film-cooling holes 116 are arranged advantageously on the pressure-side wall 114. Some film-cooling holes may optionally be provided on the suction-side wall 112. Thus, the leading-edge cavity (CL) is connected to a region external to the airfoil 106 through a plurality of film-cooling holes 116. The film-cooling holes direct the cooling fluid from the leading-edge cavity (CL) to the region external to the airfoil 106.

The trailing-edge cavity (CT) is connected to multiple discharge channels 118 located along the trailing edge 110. Such discharge channels 118 may be fabricated in accordance with any suitable technique known in the art. For example, the multiple discharge channels 118 may be provided with pin fins to achieve more effective cooling in a region surrounding the trailing edge 110. In various embodiments of the present invention, a separate cooling circuit is established in the trailing-edge cavity (CT), as will be explained in the following description.

The following description will now explain a specific construction of the turbine blade 100 in accordance with various techniques of the present invention described hereinabove.

The construction explained hereinafter is intended for an exemplary purpose only and should not be construed to limit the present invention in any manner.

As can be seen in FIGS. 2 and 3, each supply chamber 202, 202' includes at least one main leg 208, 208' and one or more auxiliary legs 210, 210'. The main leg 208, 208' and the auxiliary legs 210, 210' have a hollow construction. As will be apparent from the following description, each supply chamber 202, 202' has a substantially comb-shaped construction.

The main leg 208, 208' is located substantially towards the trailing edge 110 and extends substantially in the span-wise direction (II) from the root end 106*a* to the tip end 106*b*. The main leg 208, 208' is configured to receive the cooling fluid from the cooling-fluid source located outside the turbine blade 100 through the root end 106*a*.

The auxiliary legs 210, 210' extend from the main leg 208, 208' substantially in a chord-wise direction (I) towards the leading edge 108. The cavity inside the auxiliary legs 210, 210' is in continuum with the cavity inside the main leg 208, 208'. Thus, the auxiliary legs 210, 210' receive the cooling fluid from the main leg 208, 208'.

The main leg 208, 208' is coupled to a corresponding wall 112, 114. The coupling between the main leg 208, 208' and the corresponding wall 112, 114 is achieved using a coupling wall 212, 212' located along an end of the main leg 208, 208' towards the trailing edge 110.

In accordance with various techniques of the present invention, the main legs 208, 208' are mutually coupled substantially along ends thereof towards the trailing edge 110. As indicated in the adjoining figures, the partitioning wall 218 is used to achieve the desired coupling.

In the exemplary embodiment depicted in the adjoining figures the coupling walls 212 and 212', and the partitioning wall 218, are merged to form an integral structure.

Each auxiliary leg 210, 210' is also coupled to a corresponding wall 112, 114. The coupling between each auxiliary leg 210, 210' and the corresponding wall 112, 114 is achieved using a coupling wall 214, 214' located substantially along an end of the auxiliary leg 210, 210' opposite to the main leg 208, 208' along the chord-wise direction (I).

In this construction, the region between adjacent auxiliary legs 210, 210' forms the collector channels 206 between the impingement cavity (CI, CI') and the collector cavity (CC). Thus, for example, if the supply chamber 202, 202' includes five auxiliary legs 210, 210', four such collector channels 206 are formed.

Although one specific construction of the collector channels 206 has been explained above, it will be readily apparent to a person ordinarily skilled in the art that several different constructions are possible with regard to forming the collector cavity (CC) and providing the collector channels 206. For example, if only one auxiliary leg 210, 210' is provided, one or more collector channels 206 are formed within a region of the auxiliary leg 210, 210'. All such variations are intended to be covered within the scope of the present invention.

In one embodiment of the present invention, the main leg 208 and the main leg 208' are interconnected such as to form a combined main leg, which receives coolant fluid from the cooling-fluid source external to the turbine blade 100 and supplies to the auxiliary legs 210 and 210'.

As will be explained in conjunction with description of the flow of the coolant fluid through the turbine blade 100 later in the following description, the trailing edge cavity (CT) may be configured to receive the coolant fluid either from the main legs 208, 208' or directly from the root end 106*a*.

The flow of cooling fluid through the turbine blade 100 will now be explained.

The cooling fluid (typically cooling air) is admitted through the blade root 102, as indicated through directed arrow 'F' in FIG. 1. As mentioned earlier, the supply cavity (CS) within the supply chamber 202, 202' located inside the airfoil 106 is configured to receive cooling fluid directly from the cooling fluid source external to the turbine blade 100. The cooling fluid is directed from the supply chamber 202, 202' to the impingement cavity (CI, CI') through the impingement channels 204.

In various state of the art designs, after effecting impingement cooling of the walls 112, 114, the cooling fluid is typically discharged to an external region located outside the turbine blade 100. However, the present invention advantageously directs the cooling fluid back towards the internal region of the turbine blade 100, and further exploits the cooling capacity of the cooling fluid.

As each impingement cavity (CI, CI') is connected to the collector cavity (CC), the cooling fluid from the impingement cavity (CI, CI') is directed from the impingement cavity (CI, CI') to the leading-edge cavity (CL). The cooling fluid effects a convective cooling in the leading-edge cavity (CL). Subsequently, the cooling fluid is directed from the leading-edge cavity (CL) to a region external to the airfoil 106 through the film-cooling holes 116. The cooling fluid discharged through film cooling holes 116 forms a sheath of film over the external surface of the airfoil 106, and thereby, acts as a barrier between hot gases surrounding the turbine blade 100 and the airfoil 106.

As mentioned earlier, a separate cooling circuit is established through the trailing-edge cavity (CT).

In one exemplary embodiment of the present invention, the trailing-edge cavity (CT) is configured to receive the cooling fluid directly from the cooling-fluid source external to the turbine blade 100 through the root end 106*a* in a manner similar as that of the supply chambers 202, 202'. The cooling fluid provided to the trailing-edge cavity (CT) effects convective cooling of the suction-side and the pressure-side walls 112, 114. Subsequently, the cooling fluid is directed to a region external to the airfoil 106 through the discharge channels 118.

In an alternative embodiment, the trailing-edge cavity (CT) is configured for receiving cooling fluid from one of the supply chambers 202, 202'. This is achieved through establishing a serpentine flow path wherein a part of the cooling fluid in the supply chamber 202, 202' flows into the trailing edge cavity (CT) through a small passage formed near the tip end 106*b*, in accordance with techniques known in the art.

In each of the above implementations, the trailing-edge cavity (CT) may be further segmented through additional rib-like partitions to implement a serpentine flow along the span-wise direction within the trailing-edge cavity (CT).

As will be understood from the foregoing description, the cooling arrangement of the present invention advantageously facilitates improved cooling efficiency. Accordingly, an amount of cooling fluid required for desired heat removal is advantageously reduced.

While the present invention has been described in detail with reference to certain embodiments, it should be appreciated that the present invention is not limited to those embodiments. In view of the present disclosure, many modifications and variations would present themselves, to those of skill in the art without departing from the scope of this invention. The scope of the present invention is, therefore, indicated by the following claims rather than by the foregoing description. All changes, modifications, and variations coming within the meaning and range of equivalency of the claims are to be considered within their scope.

The invention claimed is:

1. A turbine blade comprising an airfoil, said airfoil comprising a leading edge and a trailing edge, said edges being spaced apart in a chord-wise direction and each of said edges extending in a span-wise direction from a root end of said airfoil to a tip end of said airfoil, and said edges being interconnected through a suction-side wall and a pressure-side wall, wherein between said suction-side wall and said pressure-side wall, said airfoil comprises:

at least one supply chamber configured for receiving a cooling fluid from a cooling fluid source external to said turbine blade and supplying said cooling fluid to one or more cavities within said airfoil, at least one impingement cavity connected to said at least one supply chamber through a plurality of impingement channels, said impingement channels directing said cooling fluid from said supply chamber to said impingement cavity, and a collector cavity connected to said impingement cavity through one or more collector channels, said collector channels directing said cooling fluid from said impingement cavity to said collector cavity, wherein at least a portion of said supply chamber extends parallel to one of said walls and is coupled thereto in a spaced apart relationship for defining there between said impingement cavity, whereby said impingement cavity extends parallel to said wall, and wherein said impingement channels direct said cooling fluid from said supply chamber to said impingement cavity such that jets of cooling fluid impinge upon an inner surface of said wall for effecting impingement cooling thereof, wherein said collector channels extend through said supply chamber before joining into said collector cavity.

2. The turbine blade according to claim 1, wherein said at least one supply chamber comprises a suction-side supply chamber and a pressure-side supply chamber, at least a portion of each of suction-side and pressure-side supply chambers extending parallel to said suction-side and pressure-side walls respectively, and coupled thereto in a spaced apart relationship for forming a suction-side impingement cavity and a pressure-side impingement cavity respectively.

3. The turbine blade according to claim 2, wherein said suction-side supply chamber and said pressure-side supply chamber are disposed within said airfoil such as to form there between said collector cavity, wherein said collector cavity is bounded by a leading-edge cavity towards said leading edge and a trailing-edge cavity towards said trailing edge.

4. The turbine blade according to claim 3, wherein said collector cavity is connected to said leading-edge cavity through one or more coupling slots, said coupling slots directing said cooling fluid from said collector cavity to said leading-edge cavity.

5. The turbine blade according to claim 3, wherein said suction-side and pressure-side supply chambers are mutually coupled along ends thereof towards said trailing edge through a partitioning wall such as to isolate said collector cavity from said trailing-edge cavity.

6. The turbine blade according to claim 3, wherein said leading-edge cavity is connected to a region external to said airfoil through a plurality of film-cooling holes, whereby said cooling fluid is directed from said leading-edge cavity to said region external to said airfoil.

7. The turbine blade according to claim 3, wherein said trailing-edge cavity is connected to a region external to said airfoil through a plurality of discharge channels, said discharge channels directing a cooling fluid from said trailing-edge cavity to said region external to said airfoil.

8. The turbine blade according to claim 1, wherein each of said supply chambers comprises:

at least one main leg located towards said trailing edge and extending in said span-wise direction, and configured for receiving said cooling fluid from an external source, and a plurality of auxiliary legs extending from said main leg in a chord-wise direction towards said leading edge, and configured for receiving said cooling fluid from said main leg.

9. The turbine blade according to claim 8, wherein said main leg is coupled along an end thereof towards said trailing edge to a corresponding wall through a coupling wall, and further wherein said auxiliary leg is coupled along an end thereof opposite to said main leg along said chord-wise direction to said corresponding wall through a coupling wall such that region between adjacent auxiliary legs defines said collector channels between said impingement cavity and said collector cavity.

10. The turbine blade according to claim 2, wherein number of impingement channels connecting said suction-side supply chamber to said suction-side impingement cavity exceeds number of impingement channels connecting said pressure-side supply chamber to said pressure-side impingement cavity.

11. The turbine blade according to claim 1, wherein a cross-sectional area of each collector channel exceeds a cross-sectional of each impingement channel.

12. The turbine blade according to claim 1, wherein number of said impingement channels exceeds number of said collector channels by a factor ranging from 2 to 25.

13. The turbine blade according to claim 12, wherein number of said impingement channels exceeds number of said collector channels by a factor ranging from 5 to 15.

* * * * *